US012049788B2

(12) United States Patent
Lovelace et al.

(10) Patent No.: US 12,049,788 B2
(45) Date of Patent: Jul. 30, 2024

(54) CUTTER GEOMETRY UTILIZING SPHERICAL CUTOUTS

(71) Applicant: Baker Hughes Oilfield Operations LLC, Houston, TX (US)

(72) Inventors: Kegan L. Lovelace, Houston, TX (US); Patrick Wood, Reno, NV (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 54 days.

(21) Appl. No.: 17/759,755

(22) PCT Filed: Feb. 5, 2020

(86) PCT No.: PCT/US2020/016826

§ 371 (c)(1),
(2) Date: Jul. 29, 2022

(87) PCT Pub. No.: WO2021/158215

PCT Pub. Date: Aug. 12, 2021

(65) Prior Publication Data

US 2023/0064436 A1 Mar. 2, 2023

(51) Int. Cl.
*E21B 10/567* (2006.01)

(52) U.S. Cl.
CPC ..... *E21B 10/5673* (2013.01)

(58) Field of Classification Search
CPC .... E21B 10/5673; E21B 10/567; E21B 10/56; E21B 10/52
See application file for complete search history.

(56) References Cited

U.S. PATENT DOCUMENTS

| | | | |
|---|---|---|---|
| 4,109,737 | A | 8/1978 | Bovenkerk |
| 4,529,048 | A | 7/1985 | Hall |
| 4,570,726 | A | 2/1986 | Hall |
| 4,593,777 | A | 6/1986 | Barr |
| 4,872,520 | A | 10/1989 | Nelson |
| 5,333,699 | A | 8/1994 | Thigpen et al. |

(Continued)

FOREIGN PATENT DOCUMENTS

| | | | |
|---|---|---|---|
| CN | 205259954 | U | 3/2013 |
| CN | 205778558 | U * | 12/2016 |

(Continued)

OTHER PUBLICATIONS

Liu et al., Chinese Patent No. CN-205778558-U, Dec. 2016, English Translation dated Nov. 16, 2023. (Year: 2016).*

(Continued)

*Primary Examiner* — Caroline N Butcher
(74) *Attorney, Agent, or Firm* — TraskBritt

(57) ABSTRACT

A cutting element comprising a polycrystalline diamond table having a first end attached to a substrate at an interface. The second end of the diamond table includes a concave surface, concave indentations, cutting edges at an interface between the concave surface and an outer diameter of the diamond table. Each of the at least two concave indentations intersects the concave surface and extends radially outward from the concave surface to an outer diameter of the diamond table. A method of manufacturing an earth-boring downhole tool includes providing a tool body and securing to the tool body the cutting element as recited in any one of the claims.

19 Claims, 3 Drawing Sheets

(56) References Cited

U.S. PATENT DOCUMENTS

| | | | |
|---|---|---|---|
| 5,377,773 | A | 1/1995 | Tibbitts |
| 5,437,343 | A | 8/1995 | Cooley et al. |
| 5,449,048 | A | 9/1995 | Thigpen et al. |
| 5,460,233 | A | 10/1995 | Meany et al. |
| 5,467,836 | A | 11/1995 | Grimes et al. |
| 5,499,688 | A | 3/1996 | Dennis |
| 5,871,060 | A | 2/1999 | Jensen et al. |
| 5,881,830 | A | 3/1999 | Cooley |
| 6,045,440 | A | 4/2000 | Johnson et al. |
| 6,065,554 | A | 5/2000 | Taylor et al. |
| 6,196,340 | B1 | 3/2001 | Jensen et al. |
| 6,202,770 | B1 | 3/2001 | Tibbitts |
| 6,244,365 | B1 | 6/2001 | Southland |
| 6,447,560 | B2 | 9/2002 | Jensen et al. |
| 6,481,952 | B2 | 11/2002 | Deutschle et al. |
| 6,510,910 | B2 | 1/2003 | Eyre et al. |
| 6,513,608 | B2 | 2/2003 | Eyre et al. |
| 6,550,556 | B2 | 4/2003 | Middlemiss et al. |
| 7,363,992 | B2 | 4/2008 | Stowe et al. |
| 7,726,420 | B2 | 6/2010 | Shen et al. |
| 7,757,785 | B2 | 7/2010 | Zhang et al. |
| 7,798,257 | B2 | 9/2010 | Shen et al. |
| 8,037,951 | B2 | 10/2011 | Shen et al. |
| 8,113,303 | B2 | 2/2012 | Zhang et al. |
| 8,191,656 | B2 | 6/2012 | Dourfaye et al. |
| 8,360,175 | B2 | 1/2013 | Fan et al. |
| 8,783,387 | B2 | 7/2014 | Durairajan et al. |
| 8,833,492 | B2 | 9/2014 | Durairajan et al. |
| 8,936,109 | B2 | 1/2015 | Stowe et al. |
| RE45,748 | E | 10/2015 | Zhang et al. |
| 9,376,867 | B2 | 6/2016 | Digiovanni et al. |
| 9,441,422 | B2 | 9/2016 | DiSantis |
| 9,598,909 | B2 | 3/2017 | Patel |
| 9,650,837 | B2 | 5/2017 | Patel et al. |
| 10,022,840 | B1 * | 7/2018 | Miess ..... E21B 10/567 |
| 10,125,552 | B2 | 11/2018 | Zhao et al. |
| 10,240,399 | B2 | 3/2019 | Rahmani |
| 10,287,825 | B2 | 5/2019 | Chen et al. |
| 10,309,156 | B2 | 6/2019 | Azar et al. |
| 10,378,289 | B2 | 8/2019 | Stockey |
| 10,550,644 | B2 | 2/2020 | Drews et al. |
| 10,570,668 | B2 | 2/2020 | Izbinski et al. |
| 10,605,010 | B2 | 3/2020 | De Maindreville et al. |
| 10,753,157 | B2 | 8/2020 | Rahmani |
| 10,794,118 | B2 | 10/2020 | Azar et al. |
| 10,801,268 | B2 | 10/2020 | Rahmani et al. |
| 10,907,416 | B2 | 2/2021 | Cheng et al. |
| 11,035,177 | B2 | 6/2021 | Dubose et al. |
| 11,060,356 | B2 | 7/2021 | Cuillier De Maindreville et al. |
| 11,091,960 | B2 | 8/2021 | Zhang et al. |
| 11,098,532 | B2 | 8/2021 | Gan et al. |
| 11,208,849 | B2 | 12/2021 | Rahmani et al. |
| 11,255,129 | B2 | 2/2022 | Dubose et al. |
| 2001/0030063 | A1 | 10/2001 | Dykstra et al. |
| 2002/0108791 | A1 | 8/2002 | Eyre et al. |
| 2003/0158018 | A1 | 8/2003 | Giannelli et al. |
| 2004/0097532 | A1 | 5/2004 | Jesudason et al. |
| 2004/0163851 | A1 | 8/2004 | McDonough et al. |
| 2005/0269139 | A1 | 12/2005 | Shen et al. |
| 2006/0210364 | A1 | 9/2006 | Bellmann et al. |
| 2008/0190666 | A1 | 8/2008 | Gatell |
| 2010/0059287 | A1 | 3/2010 | Durairajan et al. |
| 2010/0300765 | A1 | 12/2010 | Zhang et al. |
| 2011/0031030 | A1 | 2/2011 | Shen et al. |
| 2011/0266070 | A1 | 11/2011 | Scott et al. |
| 2013/0068534 | A1 | 3/2013 | Digiovanni et al. |
| 2013/0306377 | A1 | 11/2013 | Digiovanni et al. |
| 2016/0069140 | A1 | 3/2016 | Patel et al. |
| 2017/0037518 | A1 | 2/2017 | Oxford et al. |
| 2017/0234078 | A1 | 8/2017 | Patel et al. |
| 2018/0148978 | A1 | 5/2018 | Chen |
| 2018/0274303 | A1 | 9/2018 | Song et al. |
| 2018/0320450 | A1 | 11/2018 | Borge |
| 2018/0355672 | A1 | 12/2018 | De et al. |
| 2019/0040689 | A1 | 2/2019 | Liang et al. |
| 2019/0084087 | A1 | 3/2019 | Chapman et al. |
| 2019/0112877 | A1 | 4/2019 | Gan et al. |
| 2020/0157890 | A1 | 5/2020 | Cuillier et al. |
| 2020/0224501 | A1 | 7/2020 | Dubose et al. |
| 2020/0340303 | A1 | 10/2020 | Cheng et al. |
| 2020/0347680 | A1 | 11/2020 | Tian et al. |
| 2021/0131190 | A1 | 5/2021 | Rahmani et al. |
| 2021/0156202 | A1 | 5/2021 | Gan et al. |
| 2021/0164296 | A1 | 6/2021 | Zhao et al. |
| 2021/0172258 | A1 | 6/2021 | Graham et al. |
| 2021/0180409 | A1 | 6/2021 | Davila et al. |
| 2021/0215003 | A1 | 7/2021 | Mahajan et al. |
| 2021/0277722 | A1 | 9/2021 | Liu et al. |
| 2021/0370419 | A1 | 12/2021 | Yu et al. |
| 2021/0372203 | A1 | 12/2021 | Eyre et al. |
| 2021/0381318 | A1 | 12/2021 | Gan et al. |
| 2022/0003046 | A1 | 1/2022 | Yu et al. |
| 2022/0074271 | A1 | 3/2022 | Rahmani et al. |
| 2022/0112773 | A1 | 4/2022 | Chen et al. |
| 2022/0381092 | A1 | 12/2022 | Gan et al. |

FOREIGN PATENT DOCUMENTS

| | | | |
|---|---|---|---|
| CN | 205778558 | U | 12/2016 |
| EP | 0841463 | B1 | 3/2004 |
| GB | 2339221 | A | 1/2000 |
| KR | 10-2015-0096542 | A | 8/2015 |
| WO | 2013/040123 | A1 | 3/2013 |
| WO | 2017/172431 | A2 | 10/2017 |
| WO | 2018/231343 | A1 | 12/2018 |
| WO | 2020/102016 | A1 | 5/2020 |
| WO | 2020/131421 | | 6/2020 |
| WO | 2020/245165 | A1 | 12/2020 |
| WO | 2020/245223 | A1 | 12/2020 |
| WO | 2021/041753 | A1 | 3/2021 |
| WO | 2021/080900 | A1 | 4/2021 |
| WO | 2021/091836 | A1 | 5/2021 |
| WO | 2021/142188 | A | 7/2021 |
| WO | 2021/158218 | A1 | 8/2021 |
| WO | 2021/178304 | A1 | 10/2021 |
| WO | 2021/243361 | A1 | 12/2021 |
| WO | 2021/243362 | A1 | 12/2021 |

OTHER PUBLICATIONS

International Search Report for International Application No. PCT/US20/16826, mailed Apr. 14, 2020, 2 pages.

International Written Opinion for International Application No. PCT/US2020/016826 dated Apr. 14, 2020, 5 pages.

European Extended Search Report and Opinion for European Application No. 20917982.9, dated Sep. 18, 2023, 7 pages.

* cited by examiner

CUTTER GEOMETRY UTILIZING SPHERICAL CUTOUTS

CROSS-REFERENCE TO RELATED APPLICATION

This application is a national phase entry under 35 U.S.C. § 371 of International Patent Application PCT/US2020/016826, filed Feb. 5, 2020, designating the United States of America and published as International Patent Publication WO 2021/158215 A1 on Aug. 12, 2021.

TECHNICAL FIELD

Embodiments of the present disclosure generally relate to cutting elements for use on earth-boring tools during earth-boring operations. In particular, embodiments of the present disclosure relate to cutting elements having geometries for improved mechanical aggressiveness and efficiency.

BACKGROUND

Wellbores are formed in subterranean formations for various purposes including, for example, extraction of oil and gas from the subterranean formation and extraction of geothermal heat from the subterranean formation. Wellbores may be formed in a subterranean formation using earth-boring tools, such as an earth-boring rotary drill bit. The earth-boring rotary drill bit is rotated and advanced into the subterranean formation. As the earth-boring rotary drill bit rotates, the cutters or abrasive structures thereof cut, crush, shear, and/or abrade away the formation material to form the wellbore.

The earth-boring rotary drill bit is coupled, either directly or indirectly, to an end of what is referred to in the art as a "drill string," which comprises a series of elongated tubular segments connected end-to-end that extends into the wellbore from the surface of earth above the subterranean formations being drilled. Various tools and components, including the drill bit, may be coupled together at the distal end of the drill string at the bottom of the wellbore being drilled. This assembly of tools and components is referred to in the art as a "bottom-hole assembly" (BHA).

The earth-boring rotary drill bit may be rotated within the wellbore by rotating the drill string from the surface of the formation, or the drill bit may be rotated by coupling the drill bit to a downhole motor, which is coupled to the drill string and disposed proximate the bottom of the wellbore. The downhole motor may include, for example, a hydraulic Moineau-type motor having a shaft, to which the earth-boring rotary drill bit is mounted, that may be caused to rotate by pumping fluid (e.g., drilling mud or fluid) from the surface of the formation down through the center of the drill string, through the hydraulic motor, out from nozzles in the drill bit, and back up to the surface of the formation through the annular space between the outer surface of the drill string and the exposed surface of the formation within the wellbore. The downhole motor may be operated with or without drill string rotation.

Different types of earth-boring rotary drill bits are known in the art, including fixed-cutter bits, rolling-cutter bits, and hybrid bits (which may include, for example, both fixed cutters and rolling cutters). Fixed-cutter bits, as opposed to roller cone bits, have no moving parts and are designed to be rotated about the longitudinal axis of the drill string. Most fixed-cutter bits employ Polycrystalline Diamond Compact (PDC) cutting elements. The cutting edge of a PDC cutting element drills rock formations by shearing, like the cutting action of a lathe, as opposed to roller cone bits that drill by indenting and crushing the rock. The cutting action of the cutting edge plays a major role in the amount of energy needed to drill a rock formation.

A PDC cutting element is usually composed of a thin layer (about 3.5 mm), of polycrystalline diamond bonded to a cutting element substrate at an interface. The polycrystalline diamond table is often referred to as the "diamond table." A PDC cutting element is generally cylindrical with a diameter from about 8 mm up to about 24 mm. However, PDC cutting elements may be available in other forms such as oval or triangle-shapes and may be larger or smaller than the sizes stated above.

A PDC cutting element may be fabricated separately from the bit body and secured within cutting element pockets formed in the outer surface of a blade of the bit body. A bonding material such as an adhesive or, more typically, a braze alloy may be used to secure the PDC cutting element within the pocket. The diamond table of a PDC cutting element is formed by sintering and bonding together relatively small diamond grains under conditions of high temperature and high pressure (HTHP) in the presence of a catalyst (such as, for example, cobalt, iron, nickel, or alloys and mixtures thereof) to form a layer or "table" of polycrystalline diamond material on the cutting element substrate.

FIGS. 1A, 1B, and 1C illustrate perspective, face, and side views respectively of a prior art conventional Polycrystalline Diamond Compact (PDC) cutting element 100. The polycrystalline diamond table (diamond table) 104 is bonded to the substrate 106 at an interface 110. Before being used, a PDC cutting element 100 typically has a planar front cutting face 108 and a conventional cylindrical cutting edge 102. The planar front cutting face 108 is perpendicular to a longitudinal axis 112 of the PDC cutting element 100 and generally parallel to the interface 110 between the diamond table 104 and the substrate 106. The cutting edge 102 of the PDC cutting element 100 is at the interface between the planar front cutting face 108 and the longitudinal side surface 114 of the of the PDC cutting element 100. The cutting edge 102 of a PDC cutting element 100 drills rock formations by shearing the formation material (like the cutting action of a lathe). The cutting action of the cutting edge 102 plays a major role in the amount of energy needed to drill a rock formation. During use, as the cutting edge 102 of the PDC cutting element 100 abrades, a wear scar develops at the cutting edge 102.

The cutting element substrate 106 may comprise a cermet material (i.e., a ceramic metal composite material) such as, for example, cobalt cemented tungsten carbide. In such instances, the cobalt (or other catalyst material) in the substrate 106 may be swept into the diamond grains during sintering and serve as the catalyst material for forming the inter-granular diamond-to-diamond bonds between the diamond grains in the diamond table 104.

Upon formation of a diamond table using the HTHP process, catalyst material may remain in interstitial spaces between the grains of the diamond table. The presence of the catalyst material in the diamond table may contribute to degradation in the diamond-to-diamond bonds between the diamond grains in diamond table when the PDC cutting element 100 gets hot during use.

Degradation of the diamond-to-diamond bonds due to heat is referred to as "thermal damage" to the diamond table 104. Therefore, it is advantageous to minimize the amount heat to which a PDC cutting element 100 is exposed. This may be accomplished by reducing the rate of penetration of the earth-boring rotary drill bit. However, reduced rate of penetration, means longer drilling time and more costs associated with drilling while PDC cutting element 100 failure means stopping the drilling process to remove the drill string in order to replace the drill bit. Therefore, there is a need for cutting elements that cut more efficiently, thus improving the rate of penetration and while minimizing heat build-up in the PDC cutting element 100. Furthermore, cutting elements need to be more durable to reduce costs associated with removing and replacing the down-hole drill bit.

One method to enhance the durability of a PDC cutting element 100 is modify the cutting edge of the PDC cutting element to reduce stress points by forming a chamfer on the cutting edge of the diamond table. Forming a chamfer on the cutting edge 102 of the PDC cutting element 100 has been found to reduce the tendency of the diamond table to spall and fracture.

Multi-chamfered Polycrystalline Diamond Compact (PDC) cutting elements are also known in the art. For example, a multi-chamfered cutting element is taught by Cooley et al., U.S. Pat. No. 5,437,343, assigned to the assignee of the present invention. In particular, the Cooley et al. patent discloses a PDC cutting element having a diamond table having two concentric chamfers.

It is also known in the industry to modify the shape of the diamond table to improve cutting element efficiency and durability. U.S. Pat. No. 5,333,699 to Thigpin et al. is directed to a cutting element having a spherical first end opposite the cutting end. Cutting element variations, illustrated in FIGS. 22-29 of Thigpin et al., comprise channels or holes formed in the cutting face. U.S. Pat. No. 9,598,909 to Patel is directed to cutting elements with grooves on the cutting face as illustrated in FIGS. 9-13 of Patel.

U.S. Pat. No. 4,109,737 to Bovenkerk is directed toward cutting elements having a thin layer of polycrystalline diamond bonded to a free end of an elongated pin. One particular cutting element variation illustrated in FIG. 4G of Bovenkerk, comprises a generally hemispherical diamond layer having a plurality of flats formed on the outer surface thereof. Cutting elements with concave faces are typically not used in the industry, because at higher depths of cut, the sides of the cutting element push the cuttings back towards the center of the cutter causing the cuttings to merge. This is inefficient and may cause bit-balling and other flow problems.

U.S. Pat. No. 10,378,289 to Stockey and U.S. Patent Publication U.S. 2017/0234078 A1 to Patel et al. are directed towards a cutting face of a cutting element having multiple chamfers forming concentric rings on the cutting face. One particular cutting element variation, illustrated in FIG. 1 of Stockey, comprises a ring surface with a chamfer at the cutting edge surrounding an annular recess which in turn surrounds planar circle at the center of the cutting face. Another cutting element variation illustrated in FIG. 2 of Patel et al., comprises multiple raised ring surfaces and multiple annular recesses surrounding a planar circle at the center of the cutting face.

U.S. Pat. No. 6,196,340 to Jensen is directed to raised surface geometries on non-planar cutting elements. One variation, illustrated in FIG. 4a of Jensen, comprises a four-sided pyramidal shape with a planar square surface at the top.

U.S. Patent Publication 2018/0148978 A1 to Chen is directed toward a cutting element with a raised hexagonal shape. One cutting element variation, illustrated in FIG. 5A of Chen, comprises a raised hexagonal shape having chamfered edges. Another cutting element variation, illustrated in FIG. 5C of Chen, comprises a raised cutting surface having six round "teeth."

U.S. Pat. No. 6,550,556 to Middlemiss et al. is directed to an ultra-hard material cutter with a shaped cutting surface. Middlemiss discloses a cutting element having a radially extending depression formed on the exposed cutting element's cutting layer.

U.S. Pat. No. 8,037,951 to Shen et al. is directed to a cutting element having a shaped working surface with varying edge chamfer. One cutting element variation, illustrated in FIG. 8 of Shen, comprises a shaped working surface having three depressions and a varied geometry chamfer circumferentially around a cutting edge at the intersection of the shaped working surface and a side surface. FIGS. 18-20 illustrated alternate embodiments of cutting elements having shaped working surfaces.

U.S. Pat. No. 8,783,387 to Durairajan et al. is directed to cutting elements having geometries for high Rate of Penetration (ROP). One cutting element variation, illustrated in FIGS. 4 and 5 of Durairajan et al., comprises a cutting element having a shaped cutting surface comprising a raised triangular shape. Another cutting element variation, illustrated in FIGS. 5 and 6, of Durairajan et al., comprises a cutting element with a raised triangle having a beveled or chamfered edge.

PCT Publication WO 2018/231343 to Cuillier De Maindreville et al. is directed to superabrasive bits with multiple raised cutting surfaces. One cutting element variation, illustrated in FIG. 1, of Cuillier De Maindreville et al., comprises raised triangular shapes similar to Durairaj an et al.

U.S. Pat. No. 5,499,688 to Dennis is directed to PDC cutting elements. Cutting element variations, illustrated in FIGS. 7-11 of Dennis, comprise cutting elements with various raised shapes including triangular and hexagonal shapes.

Cutting elements with shaped surfaces and chamfered edges are known in the industry. However, a need still exists for further improvements in reliability and durability of cutting elements.

BRIEF SUMMARY

In some embodiments, the present disclosure includes a cutting element for an earth-boring tool for forming a borehole through a subterranean formation. The cutting element comprises a substrate and a diamond table wherein the diamond table has a first end and a second end. The first end of the diamond table is affixed to the substrate at an interface. The second end of the diamond table comprises a concave surface, at least two concave indentations, and at least two cutting edges at an interface between the concave surface and an outer diameter of the diamond table. Each of the at least two concave indentations intersects the concave surface and extends radially outward from the concave surface to the outer diameter of the diamond table.

In some embodiments, the present disclosure includes a method of manufacturing an earth-boring downhole tool comprising: providing a tool body and securing to the tool body the cutting element, as recited in any one of the claims.

DETAILED DESCRIPTION

Figure 1C:
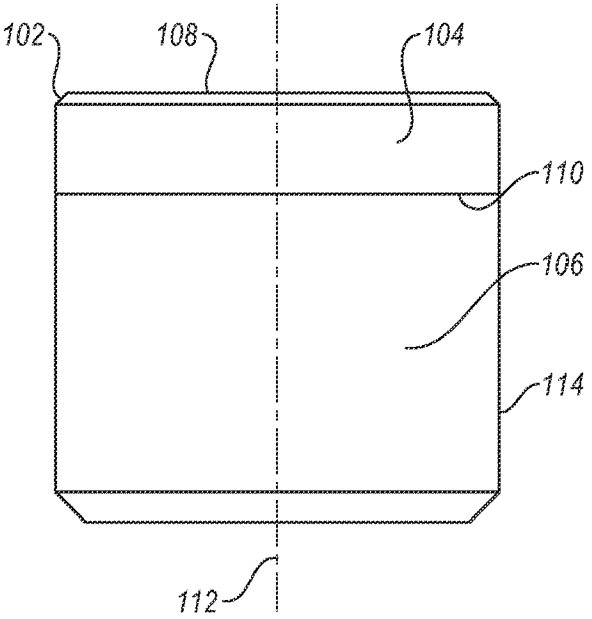
FIG. 1C (Prior Art)
FIG. 1 illustrates a prior art conventional cylindrical PDC cutting element having a conventional cylindrical planar front cutting face.

The illustrations presented herein are not actual views of any particular cutting assembly, tool, or drill string, but are merely idealized representations employed to describe example embodiments of the present disclosure. The following description provides specific details of embodiments of the present disclosure in order to provide a thorough description thereof. However, a person of ordinary skill in the art will understand that the embodiments of the disclosure may be practiced without employing many such specific details. Indeed, the embodiments of the disclosure may be practiced in conjunction with conventional techniques employed in the industry. In addition, the description provided below does not include all elements to form a complete structure or assembly. Only those process acts and structures necessary to understand the embodiments of the disclosure are described in detail below. Additional conventional acts and structures may be used. The drawings accompanying the application are for illustrative purposes only, and are not drawn to scale. Additionally, elements common between figures may have corresponding numerical designations.

As used herein, the terms "comprising," "including," "containing," "characterized by," and grammatical equivalents thereof are inclusive or open-ended terms that do not exclude additional, unrecited elements or method steps, but also include the more restrictive terms "consisting of" and "consisting essentially of" and grammatical equivalents thereof.

As used herein, the term "may" with respect to a material, structure, feature, or method act indicates that such is contemplated for use in implementation of an embodiment of the disclosure, and such term is used in preference to the more restrictive term "is" so as to avoid any implication that other compatible materials, structures, features and methods usable in combination therewith should or must be excluded.

As used herein, the term "configured" refers to a size, shape, material composition, and arrangement of one or more of at least one structure and at least one apparatus facilitating operation of one or more of the structure and the apparatus in a predetermined way.

As used herein, the singular forms following "a," "an," and "the" are intended to include the plural forms as well, unless the context clearly indicates otherwise.

As used herein, the term "and/or" includes any and all combinations of one or more of the associated listed items.

As used herein, relational terms, such as "first," "second," "top," "bottom," etc., are generally used for clarity and convenience in understanding the disclosure and accompanying drawings and do not connote or depend on any specific preference, orientation, or order, except where the context clearly indicates otherwise.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" used in reference to a given parameter is inclusive of the stated value and has the meaning dictated by the context (e.g., it includes the degree of error associated with measurement of the given parameter).

As used herein, the term "earth-boring tool" means and includes any type of bit or tool used for drilling during the formation or enlargement of a wellbore and includes, for example, rotary drill bits, percussion bits, core bits, eccentric bits, bi-center bits, reamers, mills, drag bits, roller-cone bits, hybrid bits, and other drilling bits and tools known in the art.

Improvements in the flow characteristics of cutting elements along with improvements in the cutting element efficiency and durability of cutting elements may be achieved in accordance with embodiments of the present disclosure. Downhole earth-boring tools, comprising cutting elements having novel geometries for improved flow characteristics and mechanical efficiency are described in further detail hereinbelow.

Figure 2C:
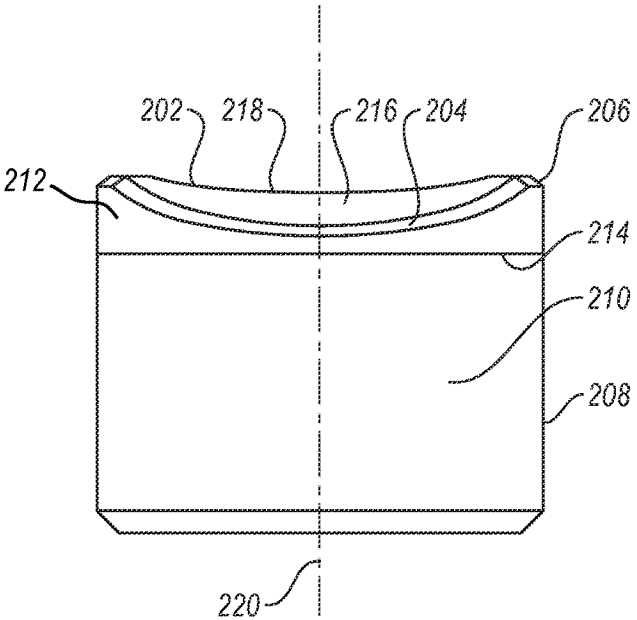
FIG. 2 illustrates a PDC cutting element, in accordance with one embodiment. The PDC cutting element has a concave surface, two cutting edges, and two concave indentations that intersect the concave surface and extend radially outward from the concave surface to an outer diameter of the diamond table.
Figure 2B:
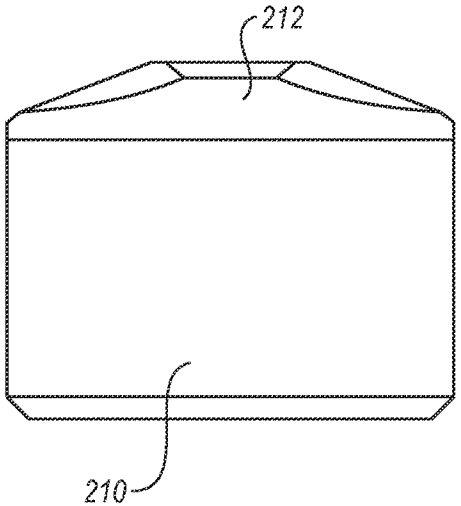
Figure 2A:
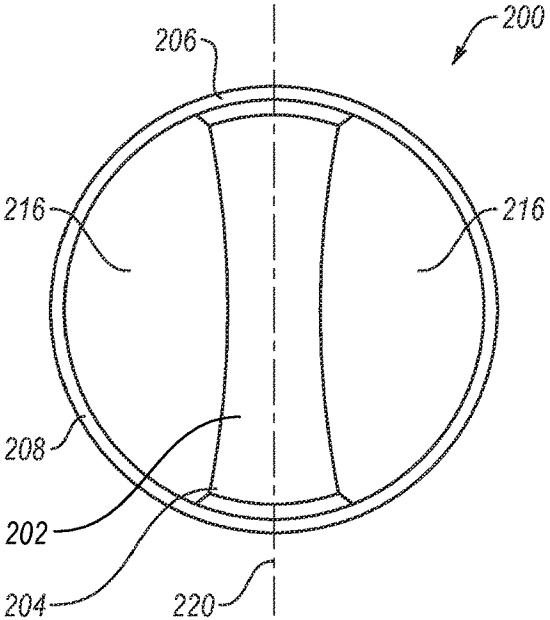

FIGS. 2A, 2B, and 2C illustrate a face view and two side views respectively of an embodiment of a PDC cutting element 200 in accordance with the present disclosure. In this embodiment, the PDC cutting element 200 comprises a diamond table 212 bonded to a substrate 210 at an interface 214. FIGS. 2A, 2B, and 2C further illustrate three concave subtractions or cutouts that have been taken from diamond table 212 thus defining a concave surface 202 and two concave indentations 216.

Figure 1B:
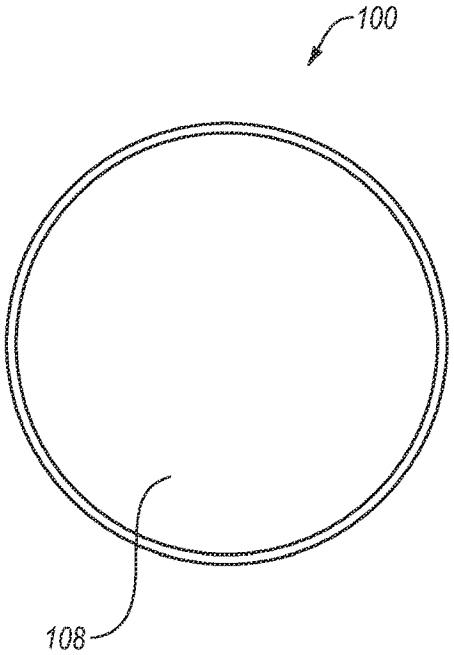
FIG. 1B (Prior Art)
Figure 1A:
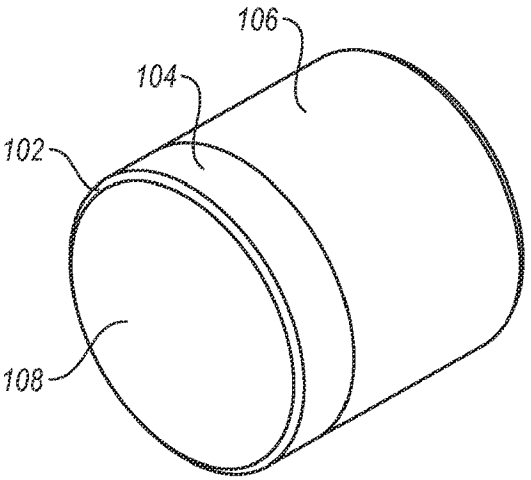
FIG. 1A (Prior Art)

The concave surface 202 forms more aggressive cutting edges 206 than the prior art planar front cutting face 108 illustrated in FIGS. 1A, 1B, and 1C and much more aggressive cutting edges 206 than the prior art domed surfaces described in the background section. As described in the background section, a cutting face having a concave surface is typically not used in the industry because the concave surface directs drilling fluid and cuttings back towards the center of the cutting element creating issues with bit balling and fluid flow. However, in the embodiment illustrated in FIGS. 2A, 2B, and 2C, the concave surface 202 is used in conjunction with the concave indentations 216 that cause drilling fluid and cuttings to flow away from the center of the PDC cutting element 200. Thus, the concave surface 202 creates more aggressive cutting edges 206 and the concave indentations 216 improve flow characteristics around the cutting edges 206. These improvements in the geometry of PDC cutting element 200 may improve the Rate of Penetration (ROP) while reducing heat, abrasion, and bit balling at the drilling face of the drill bit.

FIGS. 2A and 2C illustrates a concave surface 202 that is symmetric about line 220 and extends across the diamond table 212 from one side of the PDC cutting element 200 to the opposite side of the PDC cutting element 200, forming a dish-like top surface 218 into the diamond table 212. In some embodiments, the radius of curvature of the concave surface may be between about 10 millimeters and 250 millimeters. In some embodiments, the concave surface may define a portion of a sphere. In some embodiments, the concave surface 202 may comprise between about 10% and 90% of the overall surface area of the diamond table 212 and may extend down into as much as 25% of the thickness of the diamond table 212. In some embodiments, the concave subtraction (or cutout) process may use grinding, milling, laser machining, or any other suitable method known in the art to remove diamond material from the diamond table 212 to form the concave surface 202 and the concave indentations 216 in the diamond table 212. Two cutting edges 206 are disposed at an interface between the concave surface 202 and the outer diameter or longitudinal side surface 208 of the PDC cutting element 200.

In drilling a borehole, the optimal orientation for PDC cutting element 200 is to have one of the cutting edges 206 of the concave surface 202 oriented towards the formation material to be drilled. When significant wear has worn down the first of the cutting edges 206 of the PDC cutting element 200, the PDC cutting element 200 may be reoriented by removing the drill bit, and by removing, rotating, and reattaching the PDC cutting element 200 on the drill bit to orient the second of the cutting edges 206 towards the formation material.

FIG. 2A also illustrates two concave indentations 216 that form two edges of the concave surface 202 and extend from the concave surface 202 radially outward to an outer diameter or longitudinal side surface 208 of the diamond table 212. As illustrated in FIGS. 2A, 2B, and 2C, the two concave indentations 216 may be formed into the diamond table 212 on opposite sides of the concave surface 202, intersecting the diamond table 212 and extending radially to an outside diameter of the PDC cutting element 200. The concave indentations 216 may also symmetric with respect to line 220, which is illustrated in FIG. 2A running vertically across a center of the concave surface 202. In some embodiments, the concave indentations may each define a portion of a sphere. In some embodiments, the two concave indentations 216 may be formed into the diamond table 212 at other locations, may be adjacent to each other, and may overlap and/or merge into each other. In some embodiments, the concave indentations 216 may extend into as much as 95% of the thickness of the diamond table 212. In some embodiments, the radius of curvature between of the concave surface may be between about 5 millimeters and 125 millimeters.

FIGS. 2A, 2B, and 2C also illustrate a chamfered edge 204 along at least a portion of the cutting edges 206, and between the concave indentations 216 and the outer diameter of the diamond table (or longitudinal side surface 208 of the PDC cutting element 200). The chamfered edge 204 illustrated in the figures has a constant width around the circumference of PDC cutting element 200. As described above, a chamfered edge 204 has been found to reduce the tendency of the diamond table 212 to spall and fracture.

The order in which the concave subtractions are formed does not matter. The concave indentations 216 could be formed before or after the concave surface 202, or all of the concave subtractions could be formed in a substantially simultaneous fashion.

Figure 3C:
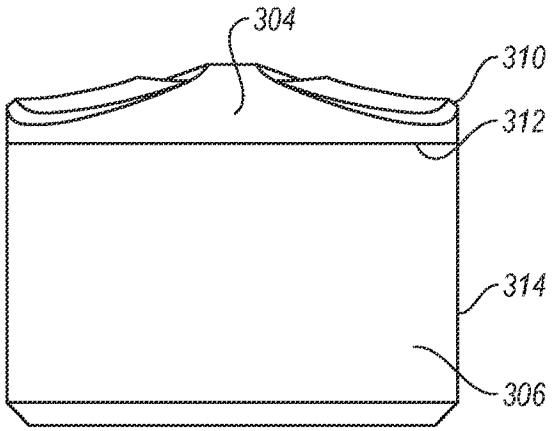
FIG. 3 illustrates a PDC cutting element, in accordance with one embodiment. The PDC cutting element has a concave surface, three cutting edges, and three concave indentations that intersect the concave surface and extend radially outward from the concave surface to an outer diameter of the diamond table.
Figure 3B:
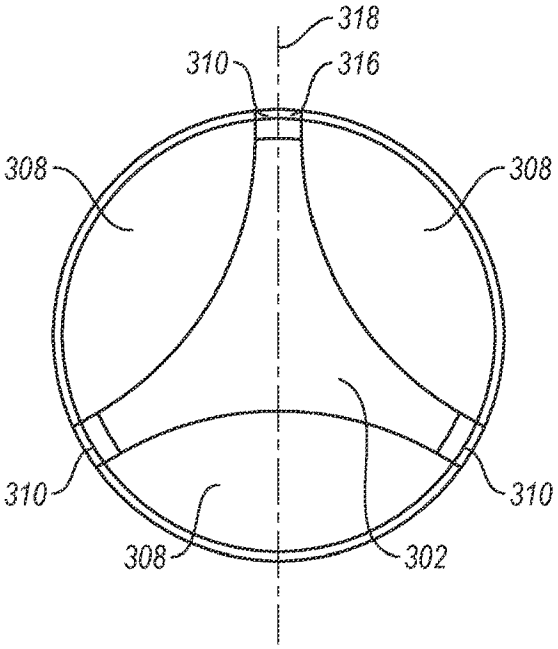
Figure 3A:
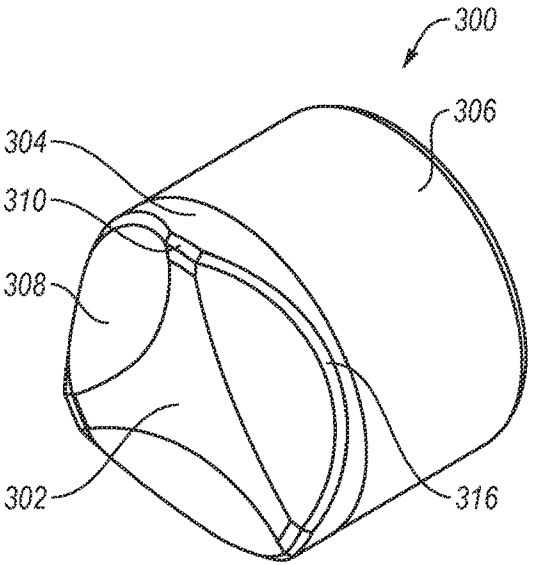

FIGS. 3A, 3B, and 3C illustrate perspective, face, and side views respectively of an embodiment of a PDC cutting element 300, in accordance with the present disclosure, in which four concave subtractions or cutouts have been taken from diamond table 304, thus defining three concave indentations 308 and a concave surface 302. The concave indentations 308 form three edges of the concave surface 302 and extend from the concave surface 302 radially outward to an outer diameter of the diamond table 304 (or longitudinal side surface 314 of the PDC cutting element 200).

In some embodiments, the PDC cutting element 300 comprises a diamond table 304 bonded to a substrate 306 at an interface 312. In some embodiments, the total thickness of the diamond table 304 may be between 1 mm and 10 mm, more preferably between 2 mm and 5 mm, more preferably about 3 mm to 3.5 mm.

As illustrated in FIGS. 3A and 3B, the top surface of the diamond table 304 comprises a concave surface 302, three concave indentations 308, and three cutting edges 310. The three concave indentations 308 extend from a concave surface 302 that is roughly triangular with curved edges. In some embodiments, the concave surface may define a portion of a sphere. FIGS. 3A, 3B, and 3C, also illustrate three concave indentations 308 that are spaced equidistantly from each other around an outer edge of the diamond table and do not meet or merge into each other. In some embodiments, the concave indentations 308 may not be spaced equidistantly from each other around an outer edge of the diamond table and may meet or merge into each other. In some embodiments, there may be four or more concave indentations. In some embodiments, the concave indentations 308 may extend into as much as 95% of the thickness of the diamond table 304. In some embodiments, the concave indentations may each define a portion of a sphere.

As illustrated in FIG. 3B, the concave surface 302 is symmetric about line 318 and extends from one side of the diamond table 304 to the opposite side of the diamond table. In the embodiment illustrated in FIGS. 3A, 3B, and 3C, the concave surface 302 is concave or dish-like. In some embodiments, concave surface 302 may extend to the outer diameter or longitudinal side surface 314 of the PDC cutting element 300. The concave surface 302 may comprise between about 10% and 90% of the overall surface area of the diamond table 304 and may extend down into as much as 25% of the thickness of the diamond table 304.

As described above, the concave indentations 308 and the concave surface 302 may be formed in the diamond table 304 by grinding, machining, milling, or any other suitable method known in the art to remove polycrystalline diamond material. Furthermore, the order in which the concave subtractions are formed does not matter. The grinding, milling, or machining, etc., to form the concave subtraction surfaces may be done in any order, or the surfaces may be formed substantially simultaneously.

FIGS. 3A, 3B, and 3C, also illustrate three cutting edges 310 disposed at an interface between the concave surface 302 and the outer diameter of the diamond table 304 (or longitudinal side surface 314 of the PDC cutting element 300). When forming a borehole, the optimal orientation for PDC cutting element 300 is to have one of the cutting edges 310 oriented (or pointed) towards the formation material to be drilled. When significant abrasion has worn down a first of the cutting edges 310 of the PDC cutting element 300, the PDC cutting element 300 may be rotated by removing the drill bit, and by removing, rotating, and reattaching the PDC cutting element 300 on the drill bit in order to orient a second (and then a third etc.) of the cutting edges 310 towards the formation material to be drilled. The concave indentations 308 may be configured and oriented to improve the flow of the drilling fluid and formation cuttings around the face of the PDC cutting element 300.

FIGS. 3A, 3B, and 3C also illustrates a chamfered edge 316 along at least a portion of the cutting edges 310, and between the concave indentations 308 and the outer diameter of the diamond table 304 (or longitudinal side surface 314 of the PDC cutting element 300). The chamfered edge 316 illustrated in the figures has a uniform width around the circumference of the PDC cutting element 300. As described above, a chamfered edge 316 has been found to reduce the tendency of the diamond table 304 to spall and fracture.

Computer modeling indicates that the concave surface 302 with concave indentations 308, will cut more efficiently and improve flow characteristics around the cutting element and the drill bit. It is expected that, drill bits having cutting elements with this improved geometry may require less torque and less weight on the bit than other prior art bits to achieve a similar Rate of Penetration (ROP). Therefore, it is expected that the concave cutting surface will last longer and be more durable than prior art bits.

The embodiments of the disclosure described above and illustrated in the accompanying drawing figures do not limit the scope of the invention, since these embodiments are merely examples of embodiments of the invention, which is defined by the appended claims and their legal equivalents. Any equivalent embodiments are intended to be within the scope of this disclosure. Indeed, various modifications of the present disclosure, in addition to those shown and described herein, such as alternative useful combinations of the elements described, may become apparent to those skilled in the art from the description. Such modifications and embodiments are also intended to fall within the scope of the appended claims and their legal equivalents.

In exemplary embodiments, a typical rotary-type "drag" bit made from steel and using PDC cutting elements is described. Those skilled in the art, however, will appreciate that the size, shape, and/or configuration of the bit may vary according to operational design parameters without departing from the spirit of the present invention. Further, the invention may be practiced on non-rotary drill bits, the invention having applicability to any drilling-related structure including percussion, impact or "hammer" bits. It will also be appreciated by one of ordinary skill in the art that one or more features of any of the illustrated embodiments may be combined with one or more features from another embodiment to form yet another combination within the scope of the invention as described and claimed herein. Thus, while certain representative embodiments and details have been shown for purposes of illustrating the invention, it will be apparent to those skilled in the art that various changes in the invention disclosed herein may be made without departing from the scope of the invention, which is defined in the appended claims.

Additional non-limiting example embodiments of the disclosure are described below.

Embodiment 1: A cutting element comprising a substrate and a diamond table wherein the diamond table has a first end and a second end. The first end of the diamond table is affixed to the substrate at a first interface. The second end of the diamond table comprises a concave surface, at least two concave indentations, and at least two cutting edges at an interface between the concave surface and an outer diameter of the diamond table. Each of the at least two concave indentations intersects the concave surface and extends radially outward from the concave surface to the outer diameter of the diamond table.

Embodiment 2: The cutting element of Embodiment 1, wherein the concave surface has a radius of curvature between 5 millimeters and 250 millimeters.

Embodiment 3: The cutting element of Embodiment 1 or Embodiment 2, wherein the concave surface covers between 10% and 90% of a total surface area of the second end of the diamond table.

Embodiment 4: The cutting element of any of Embodiments 1 through 3, wherein the concave surface and/or the concave indentations each respectively define a portion of a sphere.

Embodiment 5: The cutting element of any of Embodiments 1 through 4, wherein each of the at least two concave indentations has a radius of curvature that is between 5 millimeters and 125 millimeters.

Embodiment 6: The cutting element of any of Embodiments 1 through 5, wherein each of the at least two concave indentations extends into the diamond table to a depth of up to 95% of a thickness of the diamond table.

Embodiment 7: The cutting element of any of Embodiments 1 through 6, wherein the at least two concave indentations do not merge into each other.

Embodiment 8: The cutting element of any of Embodiments 1 through 7, wherein each of the at least two concave indentations are spaced equidistantly from each other around the outer diameter of the diamond table.

Embodiment 9: The cutting element of any of Embodiments 1 through 8, wherein the at least two cutting edges are chamfered.

Embodiment 10: The cutting element of any of Embodiments 1 through 9, wherein the at least two concave indentations comprise three concave indentations.

Embodiment 11: The cutting element of any of Embodiments 1 through 10, wherein each of the at least three concave indentations do not merge into each other.

Embodiment 12: The cutting element of any of Embodiments 1 through 11, wherein each of the at least three concave indentations are spaced equidistantly from each other around the outer diameter of the diamond table.

Embodiment 13: A method of manufacturing an earth-boring downhole tool comprising: providing a tool body and securing to the tool body, the cutting element, as recited in any one of claims 1 through 12.

Embodiment 14: The method of any of Embodiments 1 through 13, further comprising forming the concave surface and/or the at least two concave indentations by grinding.

Embodiment 15: The method of any of Embodiments 1 through 14, further comprising forming the concave surface and/or the at least two concave indentations by Electro Discharge Machining (EDM).

Embodiment 16: The method of any of Embodiments 1 through 15, further comprising forming the concave surface and/or the at least two concave indentations by laser removal.

The embodiments of the disclosure described above and illustrated in the accompanying drawing figures do not limit the scope of the invention, since these embodiments are merely examples of embodiments of the invention, which is defined by the appended claims and their legal equivalents. Any equivalent embodiments are intended to be within the scope of this disclosure. Indeed, various modifications of the present disclosure, in addition to those shown and described herein, such as alternative useful combinations of the elements described, may become apparent to those skilled in the art from the description. Such modifications and embodiments are also intended to fall within the scope of the appended claims and their legal equivalents.

What is claimed is:

1. A cutting element, comprising:

a substrate; and a diamond table having a first end and a second end, the first end of the diamond table affixed to the substrate at a first interface, the second end of the diamond table comprising:

a concave surface, the concave surface defining a portion of a sphere;

at least two concave indentations, each of the at least two concave indentations defining a portion of another sphere and intersecting the concave surface and extending radially outward from the concave surface to an outer diameter of the diamond table; and at least two cutting edges at an interface between the concave surface and the outer diameter of the diamond table.

2. The cutting element of claim 1, wherein the concave surface has a radius of curvature between 5 millimeters and 250 millimeters.

3. The cutting element of claim 1, wherein the concave surface covers between 10% and 90% of a total surface area of the second end of the diamond table.

4. The cutting element of claim 1, wherein each of the at least two concave indentations has a radius of curvature that is between 5 millimeters and 125 millimeters.

5. The cutting element of claim 1, wherein each of the at least two concave indentations extends into the diamond table to a depth of up to 95% of a thickness of the diamond table.

6. The cutting element of claim 1, wherein the at least two concave indentations do not merge into each other.

7. The cutting element of claim 1, wherein each of the at least two concave indentations are spaced equidistantly from each other around the outer diameter of the diamond table.

8. The cutting element of claim 1, wherein the at least two cutting edges are chamfered.

9. The cutting element of claim 1, wherein the at least two concave indentations comprise three concave indentations.

10. The cutting element of claim 9, wherein each of the three concave indentations do not merge into each other.

11. The cutting element of claim 9, wherein each of the three concave indentations are spaced equidistantly from each other around the outer diameter of the diamond table.

12. A method of manufacturing an earth-boring downhole tool, the method comprising:

securing the cutting element of claim 1 to a tool body.

13. The method of claim 12, further comprising forming the concave surface and/or the at least two concave indentations by grinding.

14. The method of claim 12, further comprising forming the concave surface and/or the at least two concave indentations by Electro Discharge Machining (EDM).

15. The method of claim 12, further comprising forming the concave surface and/or the at least two concave indentations by laser removal.

16. The cutting element of claim 1, wherein the concave surface extends into the diamond table to a depth of up to 25% of a thickness of the diamond table.

17. The cutting element of claim 1, further comprising a chamfered edge along a periphery of the diamond table.

18. The cutting element of claim 17, wherein the chamfered edge has a constant width.

19. The cutting element of claim 1, wherein the concave indentations are on opposite sides of the concave surface.

* * * * *